US010993540B2

(12) United States Patent
Theilmann et al.

(10) Patent No.: US 10,993,540 B2
(45) Date of Patent: May 4, 2021

(54) DYNAMIC BACKREST CONSTRUCTION

(71) Applicant: R82 A/S, Gedved (DK)

(72) Inventors: Rasmus Theilmann, Horsens (DK); Thomas Lindhardt Jensen, Horsens (DK)

(73) Assignee: R82 A/S, Gedved (DK)

( * ) Notice: Subject to any disclaimer, the term of this patent is extended or adjusted under 35 U.S.C. 154(b) by 0 days.

(21) Appl. No.: 16/596,242

(22) Filed: Oct. 8, 2019

(65) Prior Publication Data

US 2020/0113334 A1 Apr. 16, 2020

(30) Foreign Application Priority Data

Oct. 10, 2018 (DK) ..... PA 2018 70664

(51) Int. Cl.
*A47C 7/44* (2006.01)
*A61G 5/10* (2006.01)

(52) U.S. Cl.
CPC ..... *A47C 7/446* (2013.01); *A47C 7/441* (2013.01); *A47C 7/448* (2013.01); *A61G 5/1067* (2013.01); *A61G 5/1081* (2016.11); *A61G 2200/34* (2013.01); *A61G 2203/70* (2013.01)

(58) Field of Classification Search
CPC ..... A47C 7/446; A47C 7/441; A47C 7/448; A61G 5/1081; A61G 5/1067; A61G 2200/34; A61G 2203/70
USPC ..... 297/301.2
See application file for complete search history.

(56) References Cited

U.S. PATENT DOCUMENTS

| | | | |
|---|---|---|---|
| 2,018,825 | A | 10/1935 | Wood |
| 2,272,980 | A | 2/1939 | McLellan et al. |
| 4,761,033 | A | 8/1988 | Lanuzzi et al. |
| 5,228,747 | A | 7/1993 | Greene |
| 5,328,237 | A | 7/1994 | Yamaguchi et al. |

(Continued)

FOREIGN PATENT DOCUMENTS

| | | | |
|---|---|---|---|
| DE | 2843058 | A1 | 4/1980 |
| DK | 201000763 | L | 3/2011 |

(Continued)

OTHER PUBLICATIONS

European Search Report dated Feb. 18, 2020 in European Application No. 19202353, 3 pages.

(Continued)

*Primary Examiner* — Mark R Wendell
(74) *Attorney, Agent, or Firm* — Berg Hill Greenleaf Ruscitti, LLP

(57) ABSTRACT

A resilient backrest dampening mechanism is provided for use with chairs having a seat and a backrest, the mechanism comprising four pivot points; a first pivot point arranged on a base different from the backrest; a second pivot point arranged at a distance from the first pivot point on the base, wherein a bracket is pivotally connected to the second pivot point; a third pivot point provided between the bracket and a first end of a backrest connection member, and the backrest connection member being adjustably connected to the backrest; a fourth pivot point provided in the bracket; a resilient member arranged between the fourth pivot point and the first pivot point, and wherein all the pivot points pivot around corresponding axes and all of the axes are parallel.

13 Claims, 4 Drawing Sheets

(56) References Cited

U.S. PATENT DOCUMENTS

| | | | | |
|---|---|---|---|---|
| 2008/0157501 | A1* | 7/2008 | Moller | A61G 5/0891 280/250.1 |
| 2008/0252124 | A1 | 10/2008 | Chen | |
| 2011/0233972 | A1* | 9/2011 | Weicek | A47C 1/0355 297/84 |
| 2015/0108813 | A1* | 4/2015 | Muller | B60N 2/2245 297/362.11 |

FOREIGN PATENT DOCUMENTS

| | | | |
|---|---|---|---|
| DK | 177121 | B1 | 11/2011 |
| GB | 2448688 | A | 10/2008 |
| WO | 2014166495 | A1 | 10/2014 |

OTHER PUBLICATIONS

Denmark Examination Report dated May 3, 2019 in DK Application No. PA 2018 70664, filed on Oct. 10, 2018, 4 pages.

* cited by examiner

DYNAMIC BACKREST CONSTRUCTION

CROSS-REFERENCE TO RELATED APPLICATION

This application claims the benefit of and priority to DK Application No. PA 2018 70664, filed Oct. 10, 2018. The entire specification and figures of the above-referenced application is hereby incorporated in its entirety by reference.

FIELD OF THE INVENTION

The present invention relates to a dynamic backrest construction for seats in general, but particularly to seats or back rests for wheelchairs and a seat or wheelchair with such a dynamic backrest construction.

BACKGROUND OF THE INVENTION

For the comfort of disabled persons in wheelchairs it is advantageous to equip the wheelchair with a seat having a dynamic reclinable backrest that is capable of absorbing the energy of sudden and forceful voluntary or involuntary movements of the person against the backrest.

The backrest shall also for therapeutic reasons be resilient such that users with a tendency to spasms, sudden uncontrolled movements etc. are not injured when using a wheelchair.

Such a movement will tend to extend the backrest towards a more reclined position. After the energy is absorbed the backrest should be capable of returning the person to an upright sitting position.

Such a wheelchair seat is made available by the applicant with a product known as the "x:panda™". The seat in the wheelchair is equipped with a reclinable backrest having a gas spring operably positioned between the backrest and the seat for absorbing the energy of the previously described movements extending the backrest.

A seat/backrest construction incorporating a gas spring is known from U.S. Pat. No. 2,018,825. The gas spring is arranged in a fixed (but selectable) position, and serves to provide added comfort to a user.

In order to cater for persons of various weight and strength the gas spring is selected from a range of gas springs each with a fixed rating. In case of a disabled child who is still growing the gas spring may have to be replaced frequently during the life of the wheelchair, because the forces applied to the backrest increases as the weight and height of the child increase. Therefore a certain size of gas spring (a certain tension) will only be optimally suited for the seat for a limited period of time.

The inventor of the present invention previously addressed this problem in WO 2014/166495, wherein a seating arrangement comprising a backrest and a seat connected by hinges at both sides was disclosed. The hinges each incorporated gas springs, where the gas spring in one end was pivotably connected for example to the part of the hinge fastened to the backrest and the opposite end of the gas spring was mounted on a rail arranged substantially orthogonal to the longitudinal direction of the gas spring. The end of the gas spring can be moved along the rail. Consequently the resulting resilient force provided by the gas spring to the dampening action may be varied by a simple relation: arm multiplied by force; the arm being the distance from the hinges' pivot point to the position of the gas springs' position on the rail.

Although this system works well and does provide for adjustment possibilities of the resilient force, it has a number of drawbacks, one of these being the fact that in order to alter the resilient force it is necessary to adjust the mechanism (move the end of the resilient gas spring along the rail (arm)) in both hinges. It has proven difficult for the care personnel handling this during normal use, particularly to adjust the resilient force evenly in both hinges. Consequently in use there will be an uneven application of load to the hinges and thereby the entire seat construction, which may cause failure due to overload or the like.

A further drawback has proven to be the replacement of the gas spring. Although it is contemplated that this may take place in situ, i.e. in the institution where the seating construction is being used (for example in wheel chairs) this has proven to be a challenge, resulting in using the system with wrong settings thereby not achieving the advantages and benefits of the system.

A still further drawback is the relatively expensive construction. Firstly both hinge constructions are specifically designed for the particular arrangement and secondly the system requires two gas springs to be employed.

SUMMARY OF THE INVENTION

The present invention addresses these problems and others by providing a resilient back-rest dampening mechanism for use with chairs having a seat and a backrest, where the mechanism comprises four pivot points;

a first pivot point arranged on a base different from the backrest;

a second pivot point arranged at a distance from the first pivot point on said base, wherein a bracket is pivotally connected to said second pivot point, and where a third pivot point is provided between said bracket and a first end of a back rest connection member, and said back rest connection member is adjustably connected to a backrest;

where the fourth pivot point is provided in said bracket; and where between the fourth pivot point and the first pivot point is arranged a resilient member, and that all pivot points pivot around an axis, where all pivot axes are parallel.

This resilient back-rest dampening mechanism is completely independent from the hinges and the rest of the chair construction but is connected to the back-rest and to a base such that any forces deriving from movement of the backrest relative to the seat will be transferred to the base. Typically, the base will be the sub-structure for example of a wheel chair or may even be the seat in certain constructions. With this mechanism it is possible to use ordinary hinges. This facilitates a number of advantages. Particularly, within the technical field of wheel chairs or similar devices for use in the health sector, the requirements to hygiene, safety and handling are very high and often require extensive testing etc. By being able to use already approved parts such as for example hinges which is a very important part of a seat construction particularly in a wheel chair or a car seat, it becomes easier and less costly to provide constructions having the facility of a resilient back-rest dampening mechanism as this is not integrated in other constructional parts of the device in which it is desirable to have the resilient back-rest dampening mechanism.

With the construction including four pivot points of which two pivot points are interconnected by means of a resilient member, it is easy to replace the resilient member simply by interacting with the two pivot points at either end of the resilient member.

The further feature of having the resilient back-rest dampening mechanism connected to the back-rest by a back-rest connection member which is adjustably connected to the back-rest provides the facility to position the back-rest at a desired inclination and thereafter connect the back-rest connection member to the back-rest such that the dampening mechanism is only activated or engaged at the desired inclination of the back-rest.

Furthermore by only having one resilient back-rest dampening mechanism, it is ensured that the back rest is always provided with an even, resilient force, and hence no uneven back support occurs. This leads to less tear and wear, due to the even, resilient dampening force on the back-rest and thereby also on the hinges.

In a further advantageous embodiment the fourth pivot point is provided in a sliding sub-bracket integrated in the bracket where sliding of the sub-bracket is controlled, and where when sliding the sub-bracket the distance between the first and fourth pivot points is changed, changing the influence (characteristics) of the resilient member.

With this construction the (pre)-compression of the resilient member may be adjusted thereby adjusting the entire mechanism to handle specific load levels. If the resilient member is too soft, any sudden impact transferred from the back-rest to the mechanism will depress the resilient member, and without providing adequate dampening the resilient member will risk being fully compressed, thereby providing no resilient properties. On the other hand, if the resilient member is too hard, the resilient dampening of the back rest will also not fulfil its object.

By being able to alter the pre-tension/compression it is possible to adapt the dampening to a larger spectrum of users.

In a further advantageous embodiment, an alternative or in addition to the sliding sub-bracket provides that the third pivot point comprises an oblong aperture in the bracket, and where the first end of the backrest connection member is provided with an axle constituting the pivot axis, where said axle is controllably guided in said oblong aperture, such that the distance between the second pivot point and the third pivot point may be adjusted.

This construction also provides the possibility to control or alter the force transferred from the backrest to the resilient member. For both embodiments t is possible to adjust the influence of the resilient member, thereby extending the range where a specific resilient member is suitable for the same chair construction, with different users.

In a further advantageous embodiment the longitudinal direction of the oblong aperture is oriented substantially tangentially to the second pivot point. In this manner the resistance moment of inertia may be adjusted bringing about the advantages mentioned above.

For both embodiments comprising adjustable means the governing principle is that the distance between the attachment points of the resilient member may be altered. In addition to the two embodiments mentioned above where either a sub-bracket is displaced or the first end of the back rest connection member is guided for controlled movement/placement in an oblong aperture, it is also contemplated that the radial distance between the second and fourth pivot points may be changed. This can either be achieved by providing another bracket having a different distance, or providing an oblong aperture radially with respect to the second pivot point, such that the axle of the fourth pivot point may be positioned in a different/adjustable distance from the second pivot point.

In a still further advantageous embodiment of the invention, the sliding of the sub-bracket is controlled, and when sliding the sub-bracket the distance between the first and fourth pivot points is changed, changing the characteristics of the resilient member.

It is also contemplated that the change of the distance between third and fourth or second and third pivot points may be effected by an electrical actuator means.

The distance between the first and fourth pivot points corresponds to the active arm by which the spring is influenced. By changing the length of the arm it is possible to change the whole system. For example if the arm is made longer the required force is less, resulting in a softer resilient action, suitable to accept less load applied to the back-rest, whereas if the arm is made shorter, a larger force is necessary in order to activate the resilient means, suitable to dampened back-rests exposed to larger impact forces.

In a further advantageous embodiment the resilient member is a gas-spring, hydraulic-spring, pneumatic spring, a helical spring, or air cushion.

Particularly advantageous is the use of a gas, pneumatic or hydraulic spring.

Gas springs can be defined as hydro-pneumatic, energy storage elements. Nitrogen gas and oil are utilized for providing compressible and damping (motion control) mediums. Gas springs can be configured to meet a wide range of requirements.

Gas springs consist of a precision rod attached to a piston, moving within a sealed cylinder containing pressurized nitrogen gas and oil. Their force (F) is equal to the pressure differential (P) between internal and external (environment) pressures, acting on the cross-sectional area of the rod (A).

While for most applications $\Delta P$ (pressure differential) can be approximated by the spring's internal pressure (P), $\Delta P$ must be taken in consideration for gas springs used in high pressure environments (e.g. sub-sea applications).

As the piston rod is introduced into the cylinder (compression stroke), the internal gas volume decreases resulting in a proportional increase in pressure (Boyle's Law). Consequently, the force of a gas spring is higher when the rod is compressed.

The difference between the forces seen at the two extreme rod positions—named P1-force and P2-force respectively—is an important gas spring characteristic and called K-factor or gas spring progression. When compared to mechanical springs, gas springs can achieve very low K-Factors, typically ranging from 1.05 to 1.8. Unlike coil springs, gas springs are pre-loaded (pressurized) at the required P1-force which is available immediately.

For this reason, P1 force must be taken in account when calculating the force of a gas spring at a given position.

Dampers or "shocks" are devices that can restrict motion through viscous friction, usually paired with an external spring or moving masses such as doors and panels. Dampers generate an opposing force to motion which is directly proportional to velocity.

Dampers are specified by their stroke (distance travelled) and their constant of proportionality (c) between the forces generated and the velocity travelled, expressed as Force/velocity (N/m/s or Lbs/in/s). For example, to control the closing time of a door of mass "M" at the damper pivot point, using a damper stroke "S" at time "T", a damper with c=M/S/T should be specified.

The constant of proportionality for a damper is controlled by its size (defining the fluid flow rate through the piston), the piston orifice size and oil viscosity, both defining the resistance levels to oil flow. For example, a damper with a small orifice will provide more resistance to oil flow through the piston, dissipating or absorbing kinetic energy of the system attached to it. Similarly, using more viscous (thicker) oil will have the same result.

Damped gas springs are compact devices integrating a gas spring and a damper in one unit. As with dampers, the mass "M", stroke "S" and time, "T" are required to specify a damped gas spring. However, unlike dampers which generate a resisting force, damped gas springs output a controlled drive force capable of displacing the mass at the required velocity.

Fully damped gas springs can be described as damper units filled with nitrogen gas at high pressure. These units provide an even control through their stroke and can be used at any orientation.

Partially damped gas springs can be described as compression gas springs filled with high volumes of oil. These springs create a two-stage damping effect as the piston is passing through the gas (considerably less viscous than oil) and oil regions.

Therefore, by using gas or hydraulic springs, the characteristics of the resilient dampening mechanism can be designed very precisely.

Further advantageous embodiments appear from the appended claims and as described below.

DETAILED DESCRIPTION OF THE INVENTION

Figure 1:
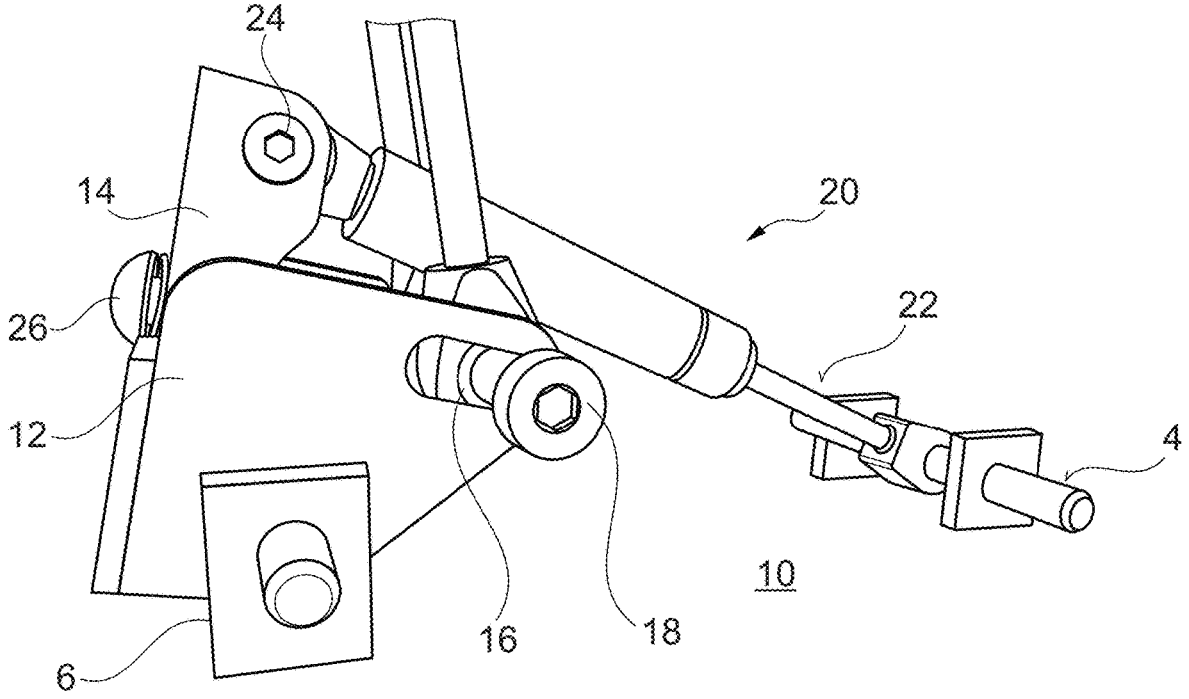
FIG. 1 illustrates the concept of the present invention.

In FIG. 1 is illustrated the concept of the present invention. The mechanism 1 is arranged on a base 10. On the base is arranged two fastenings creating a first pivot point 4 and a second pivot point 6. The second pivot point is connected to a bracket 12 such that the bracket may pivot relative to the second pivot point and thereby to the base 10. In the bracket 12 is provided a sub-bracket 14 as well as an aperture 16. In the aperture 16 is provided a third pivot point 18. The third pivot point is connected to back-rest connection means 20 which in a first end is connected to the third pivot point and in an opposite end (not illustrated) is releasably and/or adjustably connected to a back-rest. Turning back to the sub-bracket 14, a fourth pivot point 24 is provided such that a resilient member 22 may be connected between the first pivot point 4 and the fourth pivot point 24.

The sub-bracket 14 is arranged in the bracket 12 such that it may slide whereby the distance between the fourth pivot point 24 provided in the sub-bracket 14 comes closer or further away from the first pivot point 4.

All the axes of the four pivot points 4, 6, 24, 18 are parallel and as such the pivoting action is maintained in a single plane orthogonal to the orientation of the pivot axis. In order to control the sliding of the sub-bracket 14 relative to the bracket 12 and thereby the distance between the fourth pivot point 24 and the first pivot point 4, a threaded member in the shape of a bolt 26 is provided in the sub-bracket 14.

The back-rest connection member 20 is pivotally connected to the bracket through the third pivot 18. In the opposite end of the connection members 20, they are (not illustrated) releasably attached to the back-rest. In this manner it is possible to adjust the back-rest completely and independently of the resilient mechanism as neither the hinges nor the seat nor the back-rest itself are directly connected to the mechanism and as such once the comfort position of the seat and back-rest has been attained, it is possible to lock the back seat to the connection members 20 and thereby engage the resilient back-rest dampening mechanism.

The resilient back-rest dampening mechanism is also adaptable to the loads or impacts that it will be exposed to. By changing the distance between the fourth pivot point and the first pivot point, the actual distance between the fourth pivot point and a third pivot point will also change and thereby the actual distance which will influence the resilient member. If the force is constant and the arm changes, the resulting force will be changed. By adjusting the distance by rotating the bolt 26 it is possible to create a more or less firm dynamic dampening action with this mechanism.

In other situations it is desirable to replace the resilient member 22 by another resilient member having different characteristics such that for example for very light loads, the dampening mechanism will also be fulfilling its purpose namely to dampen the impacts applied to the back-rest by having a resilient member 22 which is softer. Also the opposite situation is naturally possible by installing a much firmer resilient member 22.

The sliding distance of the sub-bracket relative to the bracket determines a span of loads to which the mechanism works and also a range within which it is possible to adjust the dampening mechanism's counterforce when it is exposed to loads.

Figure 2:
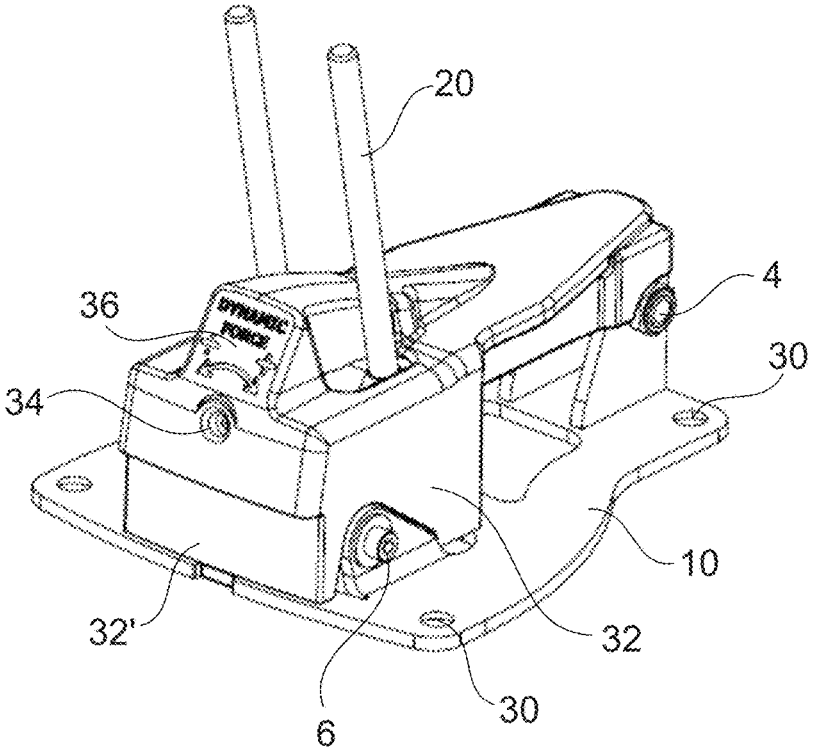
FIG. 2 illustrates an embodiment of the invention ready to be mounted in a wheel chair construction.

In FIG. 2 is illustrated an embodiment of the invention ready to be mounted in a wheel chair construction. The resilient back-rest dampening mechanism 2 is in this embodiment a more or less independent device which by means 30 such as apertures positioned in the base 10 may by fastened to a seating construction for example in a wheel chair. In this view the device 2 has been provided with appropriate covering such that only the first and second pivot points 4, 6 are visible whereas the other pivot points are covered by a cover 32. The back-rest connection member 20 extends outside the cover. At the rear end 32' of the cover 32, an aperture 34 is provided through which the bolt 26 is accessible such that by turning the bolt as indicated by the illustrations 36 on the cover 32, the dynamic force absorption properties may be adjusted up or down indicated by the plus and minus, such that the dampening mechanism is able to dampen the forces applied to the back-rest.

Figure 3:
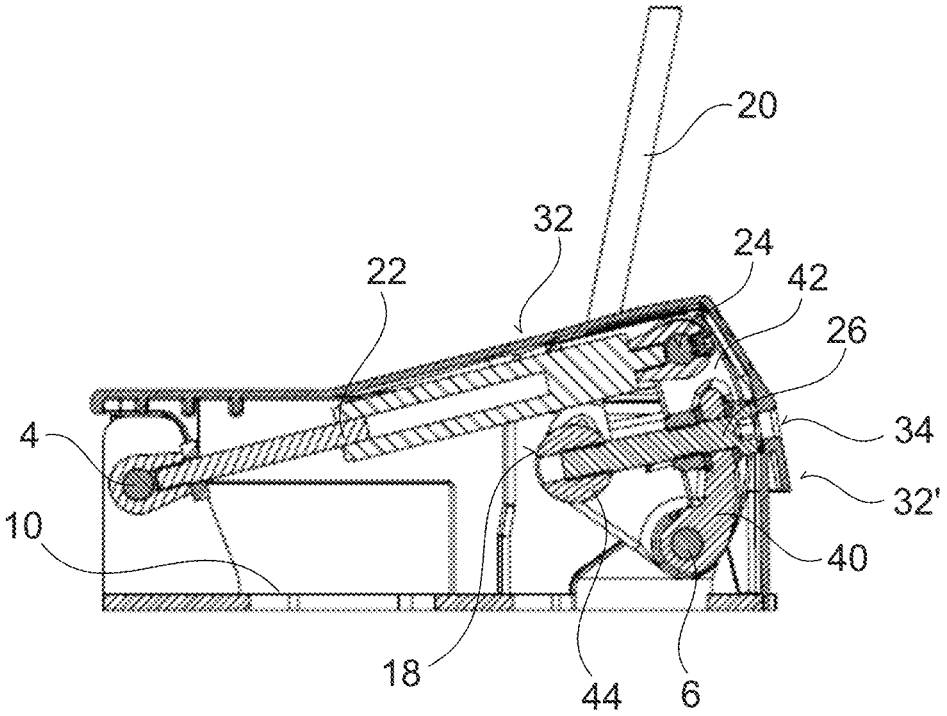
FIGS. 3 and 4 illustrate two cross sections of a further embodiment.
Figure 4:
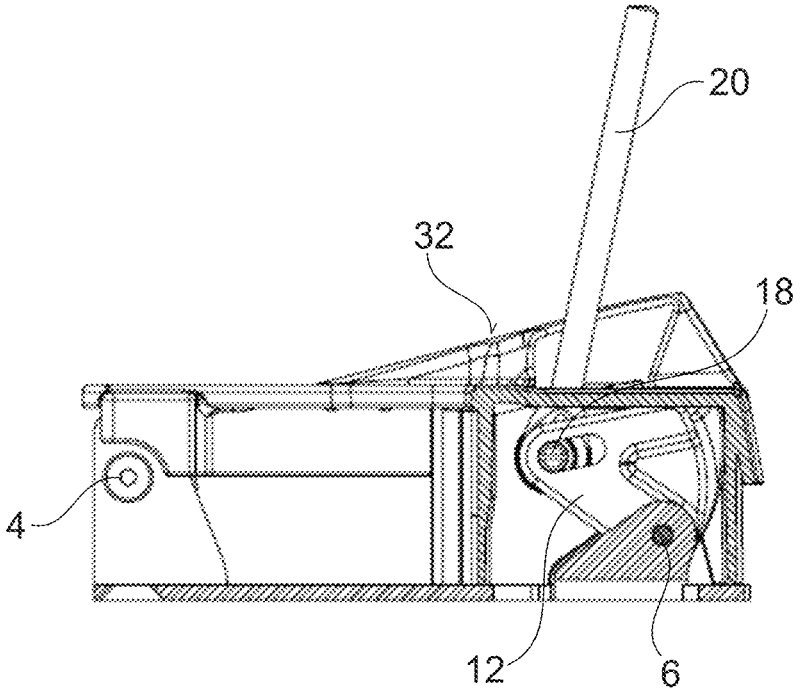

In FIGS. 3 and 4, two cross sections are illustrated through a further embodiment. From the outside it may be similar to the embodiment illustrated in FIG. 2. In FIG. 3 the first to fourth pivot points 4, 6, 18, 24 may be identified. The access aperture 34 provided in the cover 32 is illustrated as providing access to the bolt 26 such that the sub-bracket 14 may be brought closer to the first pivot point 4.

In this embodiment, there is no sub-bracket, but instead a longitudinal aperture is provided in the bracket 12. The bracket 12 comprises a lever arm 40 engaging an engagement unit 42 which engagement unit in turn is part of the fourth pivot point. Furthermore, the third pivot point's axle is guided in an oblong aperture 16 provided in the bracket. The first end of the back rest connection member is integral with the axle. A bolt 26 is threadedly engaged in the first end of the back rest connection member and the bracket, such that when the bolt is rotated the first end of the back rest connection member and the axle 18 move in the oblong aperture 16.

In this manner when the bolt 26 is rotated, the lever arm and the engagement unit are moved along the thread provided on the bolt 26. When rotating the bolt 26, a nut-like threaded section 44 will cause the bolt to be screwed more or less into or out of the nut-like construction 44 thereby displacing the lever arm and returning the engagement unit 40, 42. In this view the third pivot point is hidden by the nut-like member 44.

Turning to FIG. 4, a cross section of the mechanism 2 in a different plane is illustrated. In this view it is easy to detect the second pivot point 6 providing the bracket 12 with means to pivot around the pivot axis in pivot point 6. Also the axle 18 arranged in the oblong aperture is clearly indicated.

Figure 5:
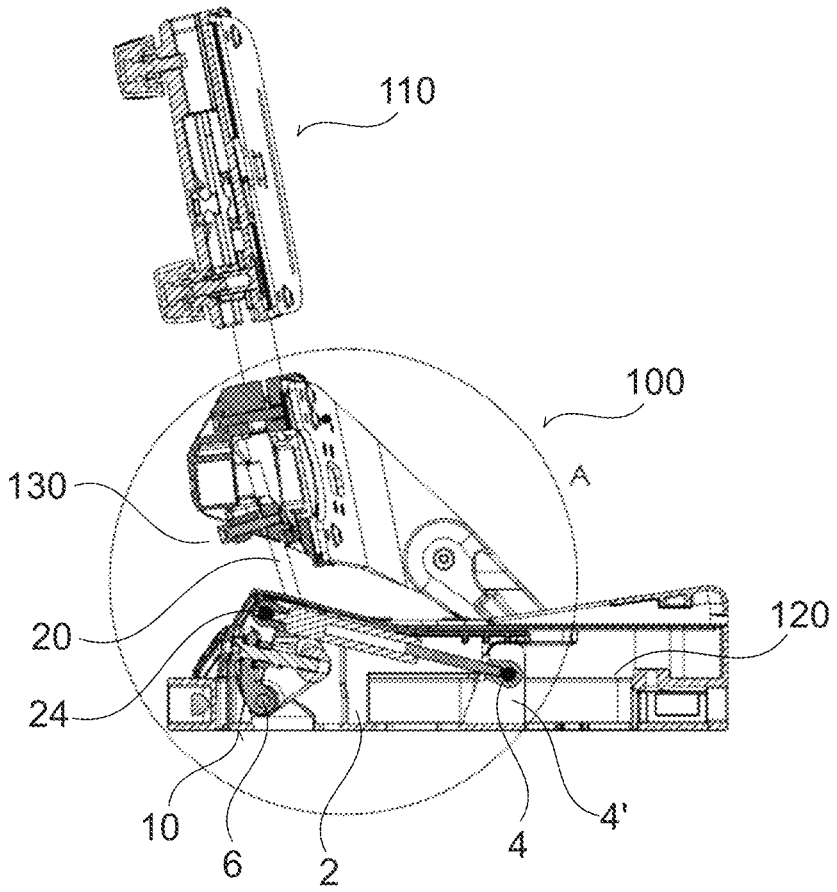
FIG. 5 illustrates a cross section through a wheel chair construction.

Turning to FIG. 5 a cross section through a wheel chair construction 100 is illustrated. The same seating construction is illustrated in different views in FIGS. 6A and 6B. Turning back to FIG. 5, it may be seen that the back-rest 110 is coupled to a seat by a hinge (not illustrated) completely different/separate from the present invention. The resilient backrest dampening mechanism 2 appears completely separate from the back-rest 110 and the seat 120. In this embodiment, however, the seating construction 120 provides the base 10 for the resilient back-rest dampening mechanism such that from the base 10, the first pivot point 4 is provided in a flange 4' upstanding from the base 10. Likewise the second pivot point 6 is provided adjacent the base 10 and the further pivot points are arranged as described above with reference to FIGS. 3 and 4.

The back-rest connection member 20 extends from the resilient back-rest dampening mechanism upwards and is engaged in a mechanism 130, provided on the rear of the back-rest construction. In this embodiment, the back-rest connection member 20 is received in a clamping mechanism where a second bolt means 132 is used to fixate the back-rest connection member's position relative to the resilient back-rest dampening mechanism 2 and the back-rest 110. By altering the position in which the clamping mechanism 130 and thereby the bolt 132 engages the back-rest mechanism, the inclination of the entire back-rest relative to the seat 120 may be adjusted completely independently of the resilient back-rest dampening mechanism 2.

Figures 6A, 6B:
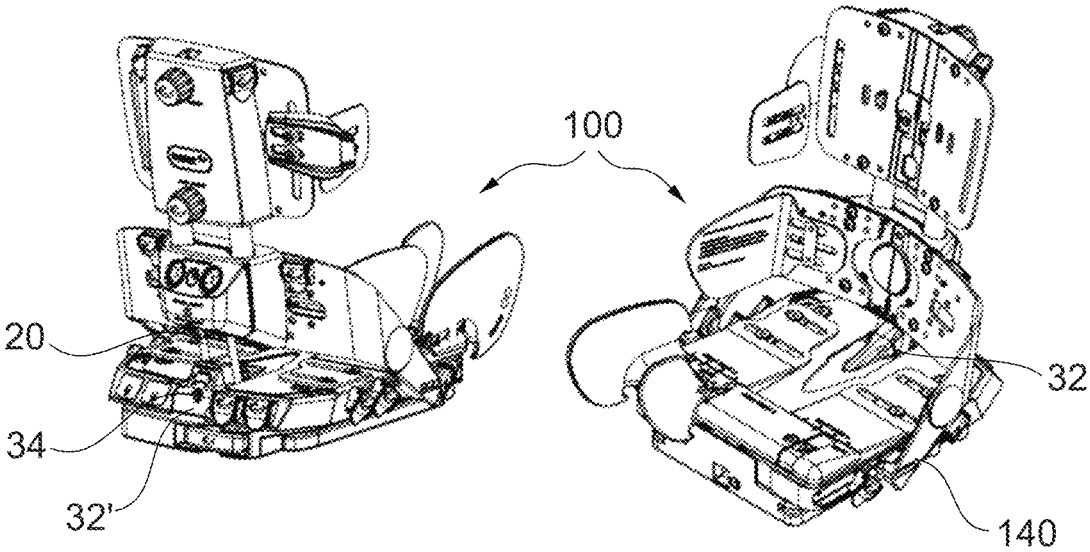
FIGS. 6A, 6B, and 7 illustrate a complete seating construction suitable for a wheel chair for special purposes.

In FIGS. 6A and 6B is illustrated a complete seating construction 100 suitable for a wheel chair for special purposes. The various aspects not related to the resilient back-rest dampening mechanism will not be mentioned. As is clear from FIG. 6A, the resilient back-rest dampening mechanism is completely integrated in the seating construction such that the rear end 32' of the cover 32 is visible from the rear of the seat and also the aperture 34 through which the bolt 26 (see FIG. 3) is accessible. The back-rest connection members 20 may also be seen. Turning to FIG. 6B, the same seat 100 is seen from the front and in this view only the cover 32 of the resilient back-rest dampening mechanism is visible. Particularly from FIGS. 6A and 6B it is clear that the back-rest and the seat are connected by hinge means 140 which are completely separate from the resilient back-rest dampening mechanism.

Figure 7:
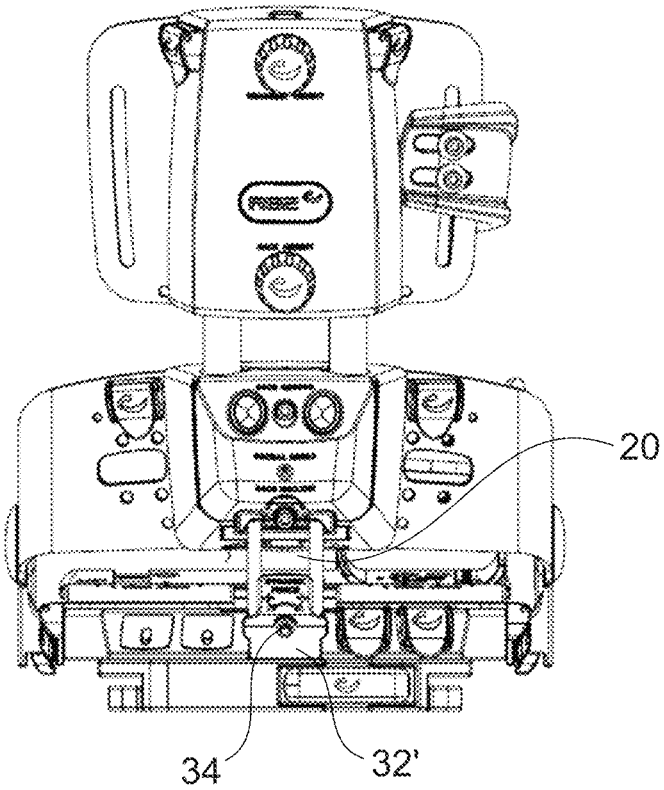

A similar view is illustrated in FIG. 7.

Above the invention has been described with reference to a specific embodiment but it is clear that the skilled person will recognize that other adaptations and implementations are also contemplated within the scope of the appended claims.

The invention claimed is:

1. A resilient backrest dampening mechanism for use with chairs having a seat and a backrest, said mechanism comprising:

a first pivot point arranged on a base different from the backrest;

a second pivot point arranged at a distance from the first pivot point on said base; wherein a bracket is pivotally connected to said second pivot point;

a third pivot point provided between said bracket and a first end of a backrest connection member, and said backrest connection member is adjustably connected to the backrest and where the third pivot point comprises an oblong aperture in the bracket, and where the first end of the backrest connection member is provided with an axle constituting the corresponding axis, where said axle is controllably guided in said oblong aperture, such that the distance between the second pivot point and the third pivot point may be adjusted;

a fourth pivot point provided in said bracket; and wherein between the fourth pivot point and the first pivot point is arranged a resilient member, all said pivot points pivot around a corresponding axis, and wherein all pivot axes are parallel.

2. The resilient backrest dampening mechanism according to claim 1, wherein:

the fourth pivot point is provided in a sliding sub-bracket integrated in the bracket where sliding of the sub-bracket is controlled, and where when sliding the sub-bracket a distance between the first and fourth pivot points is changed thereby changing an influence of the resilient member.

3. The resilient backrest dampening mechanism according to claim 2 wherein:

a position of the sub-bracket relative to the bracket is adjusted by a threaded aperture in the sub-bracket and a threaded bolt, said bolt having a head portion accessible outside the sub-bracket and bracket, and said bolt having a distal end rotatably fixed in the bracket, whereby rotation of the bolt causes the sub-bracket to move relative to the bracket, and thereby moving the fourth pivot point relative to the first pivot point.

4. The resilient backrest dampening mechanism according to claim 2 wherein:

a position of the sub-bracket relative to the bracket is adjusted by providing an electrical actuator arranged between the sub-bracket and the bracket.

5. The resilient backrest dampening mechanism according to claim 1, wherein:

a longitudinal direction of the oblong aperture is oriented substantially tangentially to the second pivot point.

6. The resilient backrest dampening mechanism according to claim 1, wherein:

the resilient member is at least one of a gas-spring, pneumatic-spring, hydraulic-spring, helical spring, or air-cushion.

7. The resilient backrest dampening mechanism according to claim 6, wherein:

the gas spring is a locking gas spring allowing the distance between the first and fourth pivot points or a distance between the first and third pivot points to be locked, the gas spring remaining resilient.

8. The resilient backrest dampening mechanism according to claim 1 wherein:

a position of the corresponding axis of the third pivot point axis relative to the bracket is adjusted by providing a threaded aperture in the bracket and a threaded bolt, said bolt having a head portion accessible outside the bracket, and said bolt having a distal end rotatably engaged with the first end of the backrest connection member, whereby rotation of the bolt causes the axle of the backrest connection member to move inside and limited in said oblong aperture, and thereby moving the third pivot point relative to the first pivot point.

9. The resilient backrest dampening mechanism according to claim 1 wherein:

a position of the axis of the third pivot point relative to the bracket is adjusted by providing an electrical actuator arranged between the bracket and the axle of the back rest connection member or between the bracket and the backrest connection member.

10. The resilient backrest dampening mechanism according to claim 1 wherein:

a connection of the resilient member at one end of the connection member or at both ends of said connection member, to the first or fourth pivot points, is dismountable such that a replacement resilient member may be mounted between said first and fourth pivot points.

11. A dampening mechanism adapted for use with a wheelchair having a chassis including a plurality of wheels, a carrying structure, and a support chair mounted on said carrying structure, said support chair having a seat and a backrest, said backrest being pivotally mounted to said support chair or said carrying structure by two hinges, and wherein a resilient backrest dampening mechanism having four pivot points is provided between said backrest and said carrying structure or seat, said dampening mechanism comprising;

a first pivot point arranged on a base different from the backrest;

a second pivot point arranged at a distance from the first pivot point on said base;

a bracket pivotally connected to said second pivot point;

a third pivot point provided between said bracket and a first end of a backrest connection member, said backrest connection member being adjustably connected to the backrest and where the third pivot point comprises an oblong aperture in the bracket, and where the first end of the backrest connection member is provided with an axle constituting the corresponding axis, where said axle is controllably guided in said oblong aperture, such that the distance between the second pivot point and the third pivot point may be adjusted;

a fourth pivot point provided in said bracket;

a resilient member arranged between the fourth pivot point and the first pivot point;

all said pivot points pivoting around a corresponding axis, and all said pivot axes being parallel, and wherein the backrest connection member is engaged by a clamping mechanism provided on the backrest to thereby fix the backrest connection member relative to the backrest.

12. A method of using a resilient backrest dampening mechanism according to claim 1, wherein:

the backrest of the seat is adjusted to a desired inclination;

means provided in a back of the backrest are activated to fixate connection means connecting the backrest to the resilient member thereby activating the resilient member.

13. The method according to claim 12, wherein:

the resilient member includes a gas spring installed between the first pivot point and the fourth pivot point thereby providing an adequate counter-force and dampening in response to impact forces on the backrest.

* * * * *